US011370086B2

(12) United States Patent
Wu

(10) Patent No.: US 11,370,086 B2
(45) Date of Patent: Jun. 28, 2022

(54) KNIFE SHARPENER

(71) Applicant: Shih-Piao Wu, Changhua (TW)

(72) Inventor: Shih-Piao Wu, Changhua (TW)

( * ) Notice: Subject to any disclaimer, the term of this patent is extended or adjusted under 35 U.S.C. 154(b) by 484 days.

(21) Appl. No.: 16/436,889

(22) Filed: Jun. 10, 2019

(65) Prior Publication Data

US 2020/0384611 A1 Dec. 10, 2020

(51) Int. Cl.
*B24D 15/08* (2006.01)
*B24B 41/06* (2012.01)

(52) U.S. Cl.
CPC ..... *B24D 15/08* (2013.01); *B24B 41/065* (2013.01)

(58) Field of Classification Search
CPC .... B24D 15/08; B24D 15/081; B24D 15/063; B24D 15/065; B24B 3/543; B24B 3/54; B24B 3/52; B24B 3/36; B24B 19/001; B24B 19/002
USPC ..... 451/45, 555
See application file for complete search history.

(56) References Cited

U.S. PATENT DOCUMENTS 7,153,200 B1 * 12/2006 Wu ..... B24B 41/00 451/344
8,485,867 B2 * 7/2013 Wu ..... B24D 15/065 451/349
8,715,041 B2 * 5/2014 Wu ..... B24D 15/065 451/552
9,308,625 B2 * 4/2016 Wu ..... B24D 15/081
2016/0368116 A1 * 12/2016 Wu ..... B24D 15/081
2018/0104796 A1 * 4/2018 Wu ..... B24D 15/081
2019/0358763 A1 * 11/2019 Hessler ..... B24B 49/12

FOREIGN PATENT DOCUMENTS

DE 102016115596 A1 * 3/2018 ..... B24D 15/081

OTHER PUBLICATIONS

Machine Translation of DE102016115596 (Year: 2016).*

* cited by examiner

*Primary Examiner* — Joel D Crandall
*Assistant Examiner* — Robert F Neibaur
(74) *Attorney, Agent, or Firm* — Che-Yang Chen; Law Office of Michael Chen

(57) ABSTRACT

A knife sharpener may include a suction cup, a main base, a sharpening set, a first cover, a control handle, and an upper cover. The suction cup is adapted to create vacuum so as to enable the knife sharpener to be attached on a working surface, and a lever extends from a top surface of the suction cup. The main base has different heights of a first portion and a second portion thereon to form a stepped shape. The sharpening set comprises two pieces of sharpening stones which are coupled together to form a sharpening space therebetween. The first cover having appropriate transparency is a board body. The control handle has a second through hole axially penetrating through a central portion thereof, and an abutting block is horizontally extended from the connecting portion to protrude from a rear end of the control handle.

8 Claims, 8 Drawing Sheets

KNIFE SHARPENER

FIELD OF THE INVENTION

The present invention relates to a knife sharpener and more particularly to a knife sharpener.

BACKGROUND OF THE INVENTION

Generally, a knife is gradually dull after a period of use, and, typically, the sharpening stone is used to sharpen and refine the blades of knife through grinding and honing. The traditional sharpening stone is bulky and not easy to store, so that most of the sharpening stone now on the market are cut and positioned on a knife sharpener base for convenient use.

However, the conventional knife sharpener has following disadvantages: when using, a user needs to use one hand to hold the knife sharpener base and, meanwhile, use the other hand to hold the knife and slide on the sharpening stone, which is dangerous to use. Therefore, there remains a need for a new and improved design for a knife sharpener to overcome the problems presented above.

SUMMARY OF THE INVENTION

The present invent provides a knife sharpener which comprises a suction cup, a main base, a sharpening set, a first cover, a control handle, and an upper cover. The suction cup is adapted to create vacuum so as to attach the knife sharpener on a working surface, and a lever extends from a top surface of the suction cup. The main base has different heights of a first portion and a second portion thereon to form a stepped shape, and the height of the second portion is higher than the first portion. The first portion comprises a first through hole thereon. When an upper end of the suction cup is coupled on a lower end of the main base, the lever is adapted to penetrate through the first through hole of the main base. A first hole is formed on a top surface of the second portion, and a curved receiving space is formed at a front end of the second portion which is located away from the first portion, and a concave surface of the curved receiving space is faced toward the first portion. A locating groove is formed below the receiving space, and the first cover is engaged with the locating groove when received into the receiving space. An indicating member is configured to be coupled between the receiving space and the first cover, and the position of the indicating member is secured when the upper cover is coupled with the top surface of the second portion. The sharpening set comprises two pieces of sharpening stones which are coupled together to form a sharpening space therebetween. The first cover having appropriate transparency is a board body which is shaped according to the receiving space, and an upper locating piece and a lower locating piece respectively and vertically protrude from an upper edge and a lower edge of the first cover. When the first cover is received in the receiving space, the lower locating piece is adapted to insert into the locating groove, and the upper cover is downwardly coupled with the main base. The upper cover has a blocking edge downwardly protruding from a front edge of the upper cover, and the blocking edge is adapted to block a front end of the upper locating piece when the upper cover is downwardly coupled with the main base. The upper cover is detachable so that the first cover and the indicating member are respectively replaceable according to the actual needs. The control handle, which is a ring body, has a second through hole axially penetrating through a central portion thereof, and a connecting portion vertically protrudes from a middle portion of a lower end of the control handle, and an abutting block is horizontally extended from the connecting portion to protrude from a rear end of the control handle. Through the connecting portion, the control handle is pivotally connected to the lever which upwardly protrudes out from the first through hole, and the second through hole is adapted to be penetrated through by the upper cover. When the control handle is pulled, the abutting block is configured to abut against the first portion so as to pull the suction cup to create vacuum. A third through hole is configured to penetrate through a top surface of the upper cover, and a vertical supporting block having a triangular notch on top is formed on the top surface of the upper cover and located directly behind the third through hole. A front end of the supporting block is coupled with the two sharpening stones so as to form a stepped shape. The sharpening set is positioned into the first hole of the main base, and the upper cover is secured with the second portion of the main base so as to secure the position of the sharpening set on the main base. An upper portion of the sharpening set is adapted to upwardly stick out from the third through hole, and two rear portions of the two sharpening stones are adapted to be abutted against the supporting block so as to enhance the stability of the knife sharpener when grinding.

Comparing with conventional knife sharpener, the present invention is advantageous because: (i) with the suction cup, the knife sharpener of the present invention can be attached on a plan surface, so that a user has no need to use one hand to hold the knife sharpener, which is more safe to use; and (ii) with the first cover and the indicating member, the knife sharpener of the present invention can meet different customer needs including presenting business and personal appearance, and distinguishing the use for different sharpening items, thereby improving the practicality thereof.

DETAILED DESCRIPTION OF THE INVENTION

Figure 1:
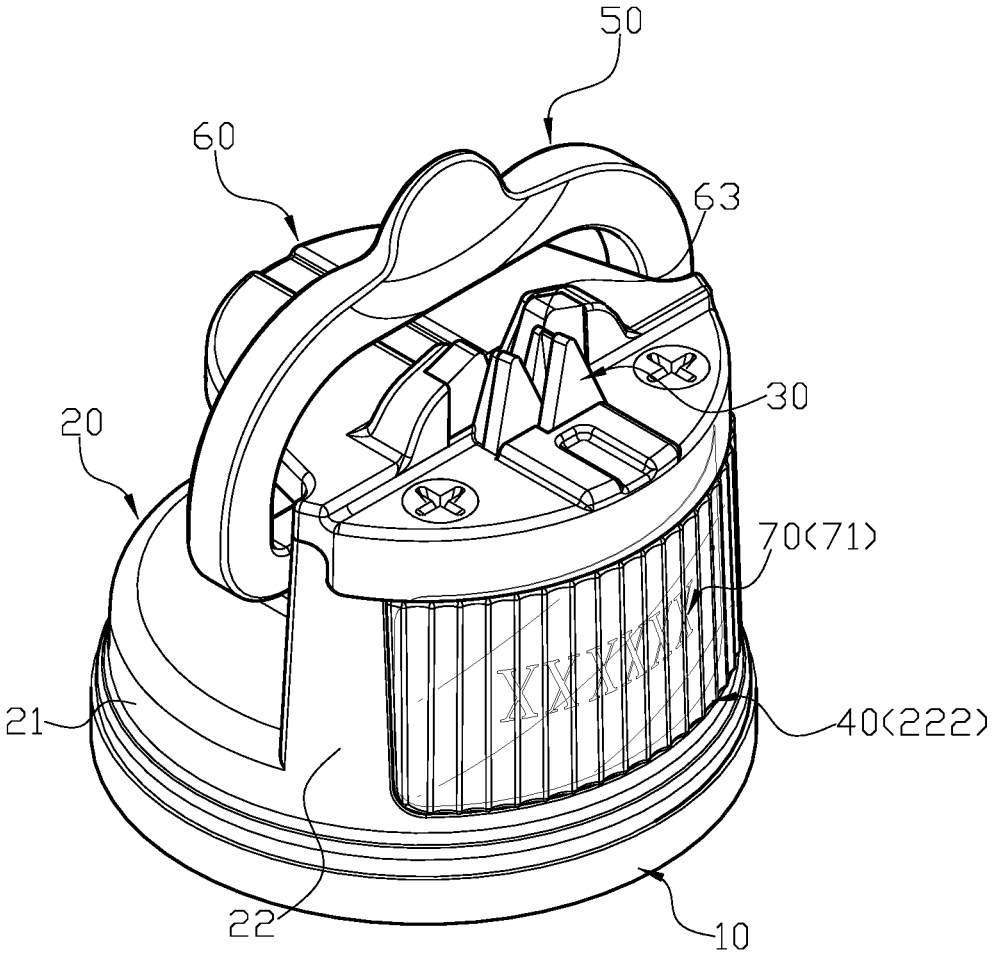
FIG. 1 is a three-dimensional assembly view of a knife sharpener of the present invention.
Figure 2:
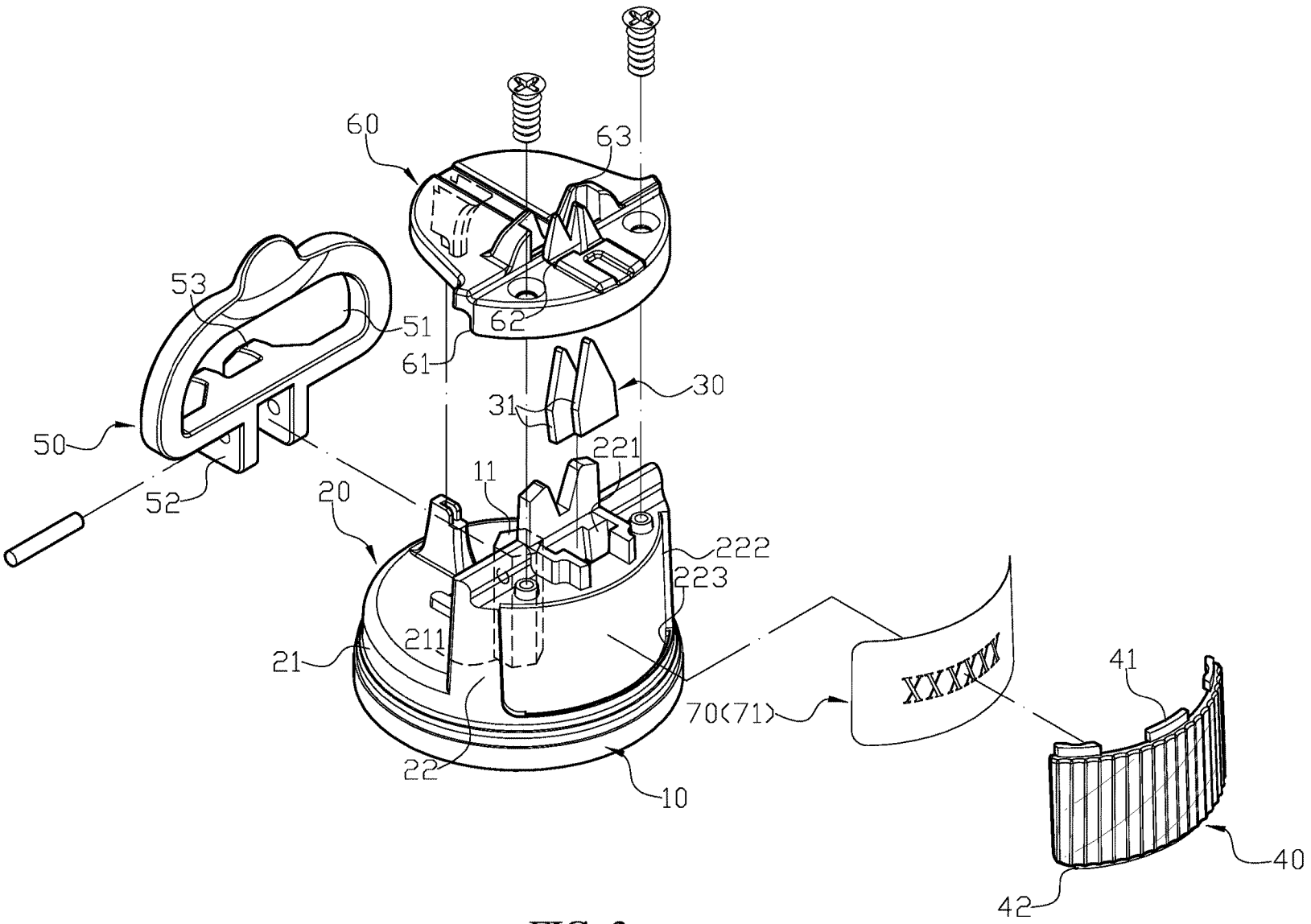
FIG. 2 is a three-dimensional exploded view of the knife sharpener of the present invention.
Figure 3:
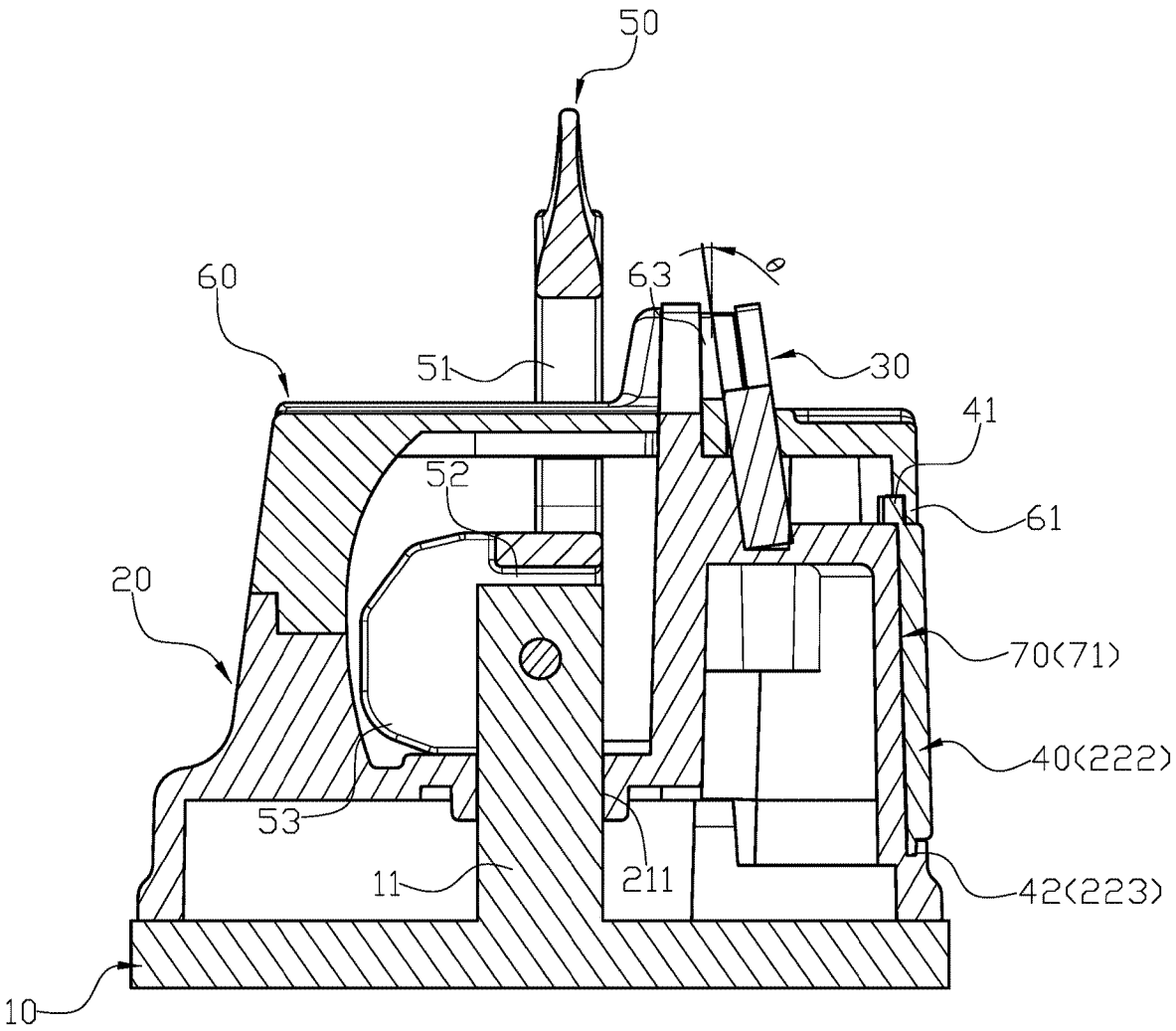
FIG. 3 is a sectional assembly view of the knife sharpener of the present invention.
Figure 4:
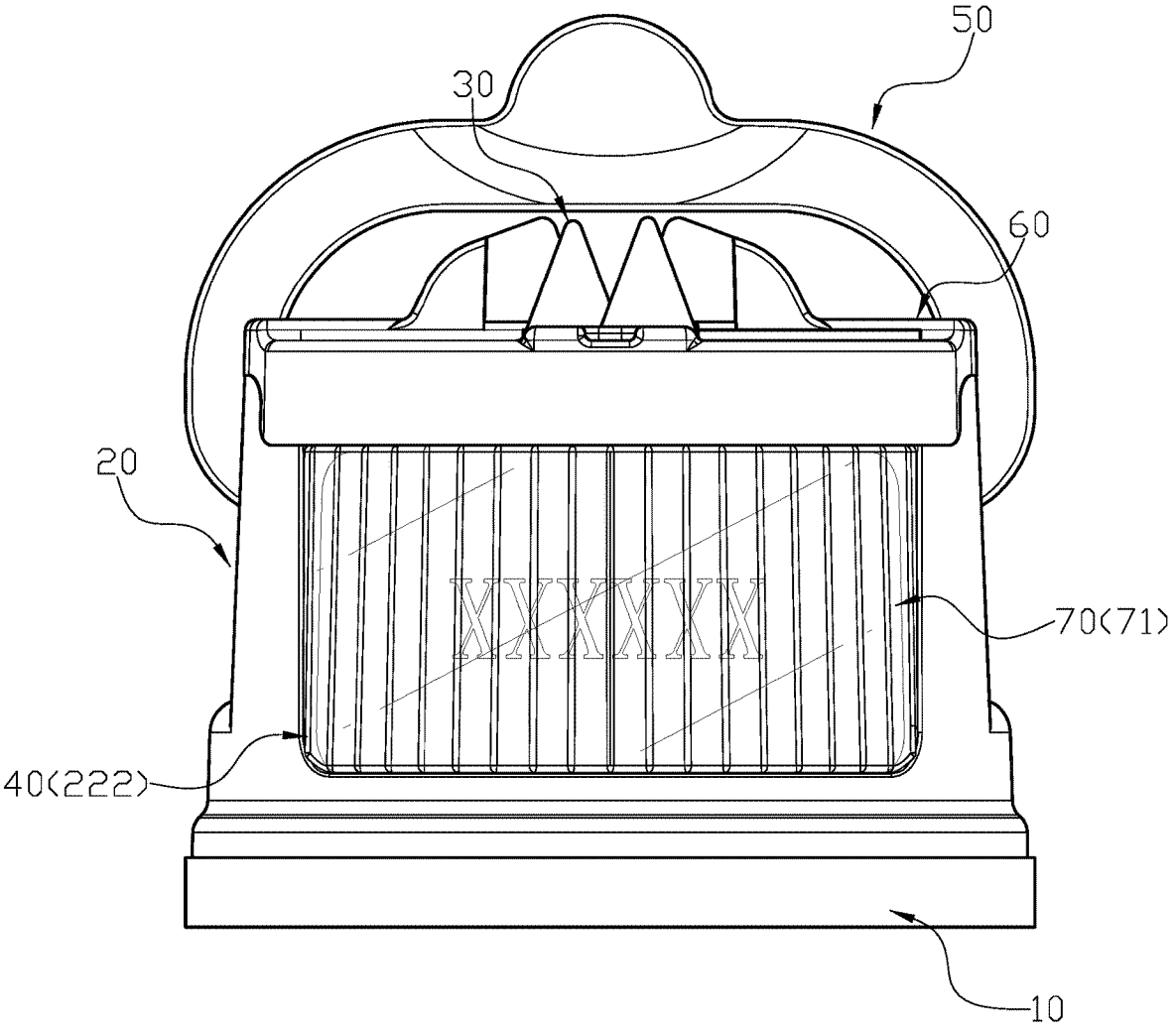
FIG. 4 is a plan assembly view of the knife sharpener of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a knife sharpener which comprises a suction cup (10), a main base (20), a sharpening set (30), a first cover (40), a control handle (50), and an upper cover (60). The suction cup (10) is adapted to create vacuum so as to attach on a working surface, and a lever (11) extends from a top surface of the suction cup (10). The main base (20) has different heights of a first portion (21) and a second portion (22) thereon to form a stepped shape, and the height of the second portion (22) is higher than the first portion (21). The first portion (21) comprises a first through hole (211) thereon. When an upper end of the suction cup (10) is coupled on a lower end of the main base (20), the lever (11) is adapted to penetrate through the first through hole (211) of the main base (20). A first hole (221) is formed on a top surface of the second portion (22), and a curved receiving space (222) is formed at a front end of the second portion (22) which is located away from the first portion (21), and a concave surface of the curved receiving space (222) is faced toward the first portion (21). A locating groove (223) is formed below the receiving space (222), and the first cover (40) is engaged with the locating groove (223) when received into the receiving space (222). Moreover, an indicating member (70) is configured to be coupled between the receiving space (222) and the first cover (40), and the position of the indicating member (70) is secured when the upper cover (60) is coupled with the top surface of the second portion (22). The sharpening set (30) comprises two pieces of sharpening stones (30) which are coupled together to form a sharpening space therebetween. The first cover (40) having appropriate transparency is a board body which is shaped according to the receiving space (222), and an upper locating piece (41) and a lower locating piece (42) respectively and vertically protrude from an upper edge and a lower edge of the first cover (40). When the first cover (40) is received in the receiving space (222), the lower locating piece (42) is adapted to insert into the locating groove (223), and the upper cover (60) is downwardly coupled with the main base (20). The upper cover (60) has a blocking edge (61) downwardly protruding from a front edge of the upper cover (60), and the blocking edge (61) is adapted to block the upper locating piece (41) at a front end thereof when the upper cover (60) is downwardly coupled with the main base (20). The upper cover (60) is detachable so that the first cover (40) and the indicating member (70) are replaceable according to the actual needs. The control handle (50), which is a ring body, has a second through hole (51) axially penetrating through a central portion thereof, and a connecting portion (52) vertically protrudes from a middle portion of a lower end of the control handle (50), and an abutting block (53) is horizontally extended from the connecting portion (52) to protrude from a rear end of the control handle (50). When the control handle (50) is pivotally connected to the lever (11), which upwardly protrudes out from the first through hole (211), through the connecting portion (52), the second through hole (51) is adapted to be penetrated through by the upper cover (60). Also, when the control handle (50) is pulled, the abutting block (53) is configured to abut against the first portion (21) so as to pull the suction cup (10) to create vacuum. A third through hole (62) is configured to penetrate through a top surface of the upper cover (60), and a vertical supporting block (63) having a triangular notch on top is formed on the top surface of the upper cover (60) and located directly behind the third through hole (62). A front end of the supporting block (63) is coupled with the two sharpening stones (31) so as to form a stepped shape. The sharpening set (30) is positioned into the first hole (221) of the main base (20), and the upper cover (60) is secured with the second portion (22) of the main base (20) so as to secure the position of the sharpening set (30) on the main base (20). An upper portion of the sharpening set (30) is adapted to upwardly stick out from the third through hole (62), and two rear portions of the two sharpening stones (31) are adapted to be abutted against the supporting block (63) so as to enhance the stability of the knife sharpener when grinding.

In one embodiment, a spring is coupled between the suction cup (10) and the main base (20) (not shown in FIGs.).

In another embodiment, the first hole (221), the third through hole (62), and the supporting block (63) are formed at a tilted angle to enable the sharpening set (30) to be rearward tilted at 5-10 degree of inclination angle (θ) relative to the vertical line after installed on the main base (20).

In still another embodiment, the indicating member (70) is a nameplate (71) which is adapted to represent a corporation or personal image (as shown in FIGS. 1 to 4).

Figure 5:
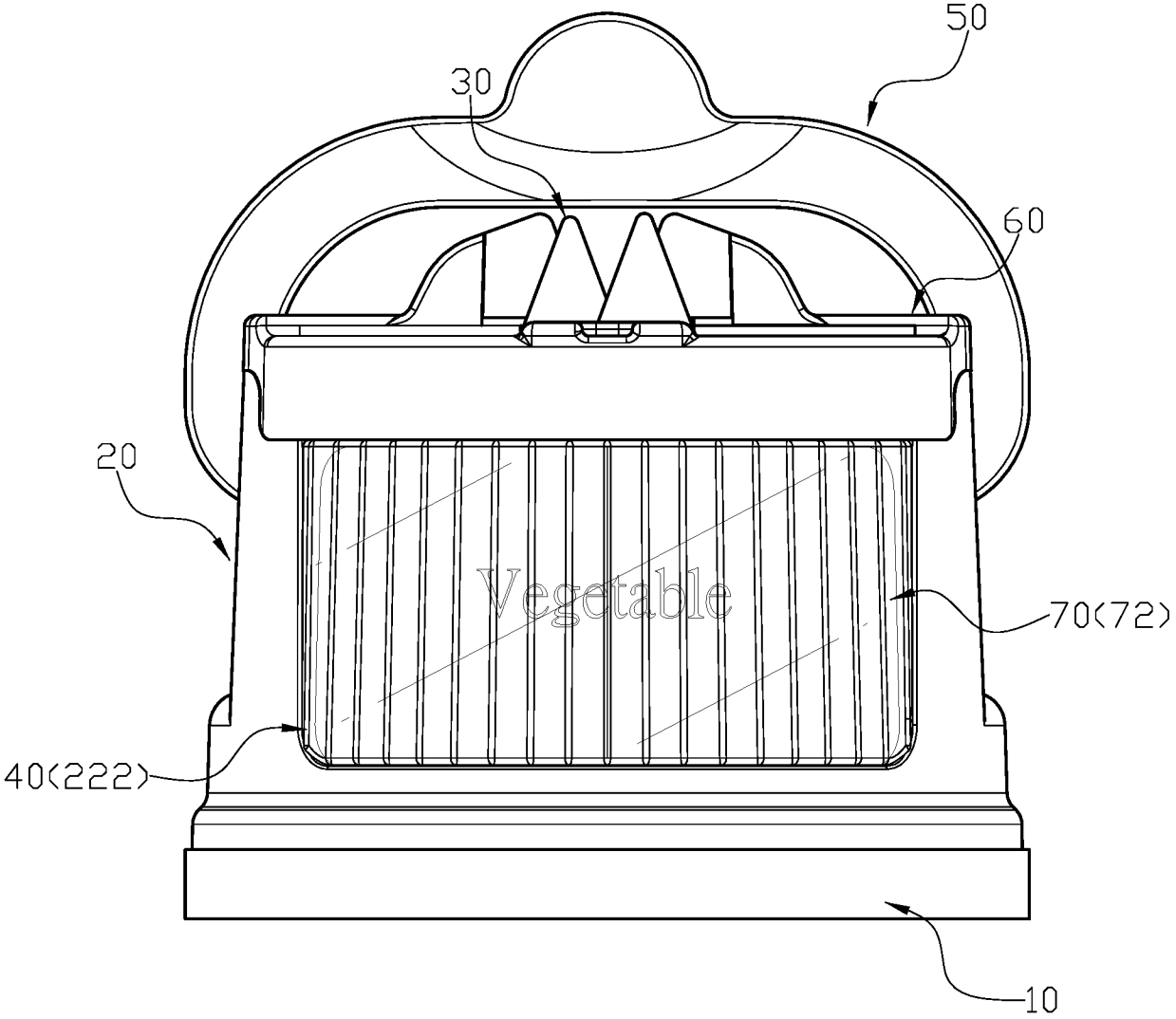
FIG. 5 is plan assembly view of a second embodiment of the knife sharpener in the present invention.
Figure 6:
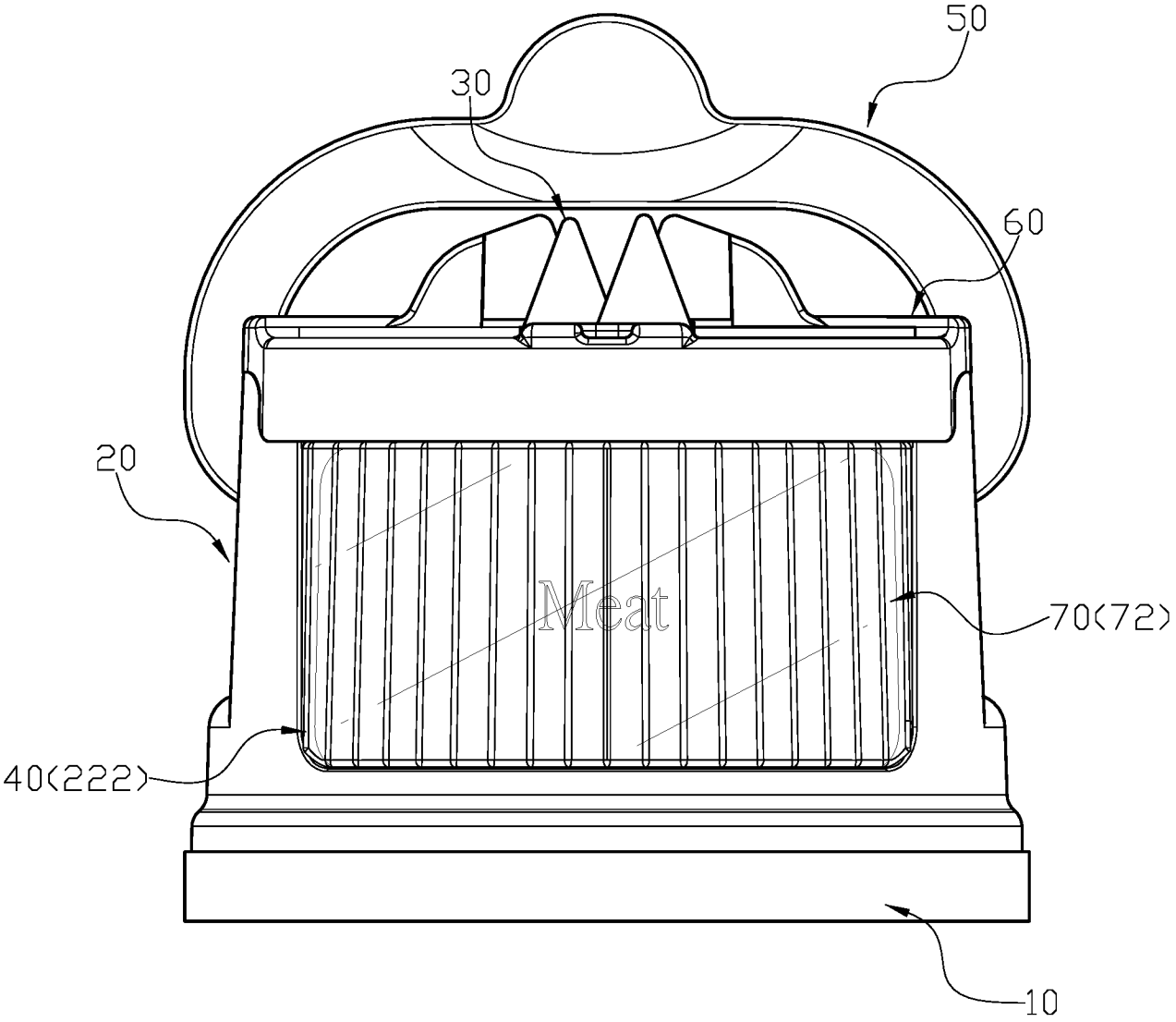
FIG. 6 is a plan assembly view of a third embodiment of the knife sharpener in the present invention.

In a further embodiment, the indicating member (70) is a paper sheet (72) that distinguishes the use for different sharpening items such as sharpening a knife used for vegetable or meat (as shown in FIGS. 5 and 6).

In still a further embodiment, the upper locating piece (41) of the first cover (40) comprises a plurality of pieces separated from each other.

Figure 7:
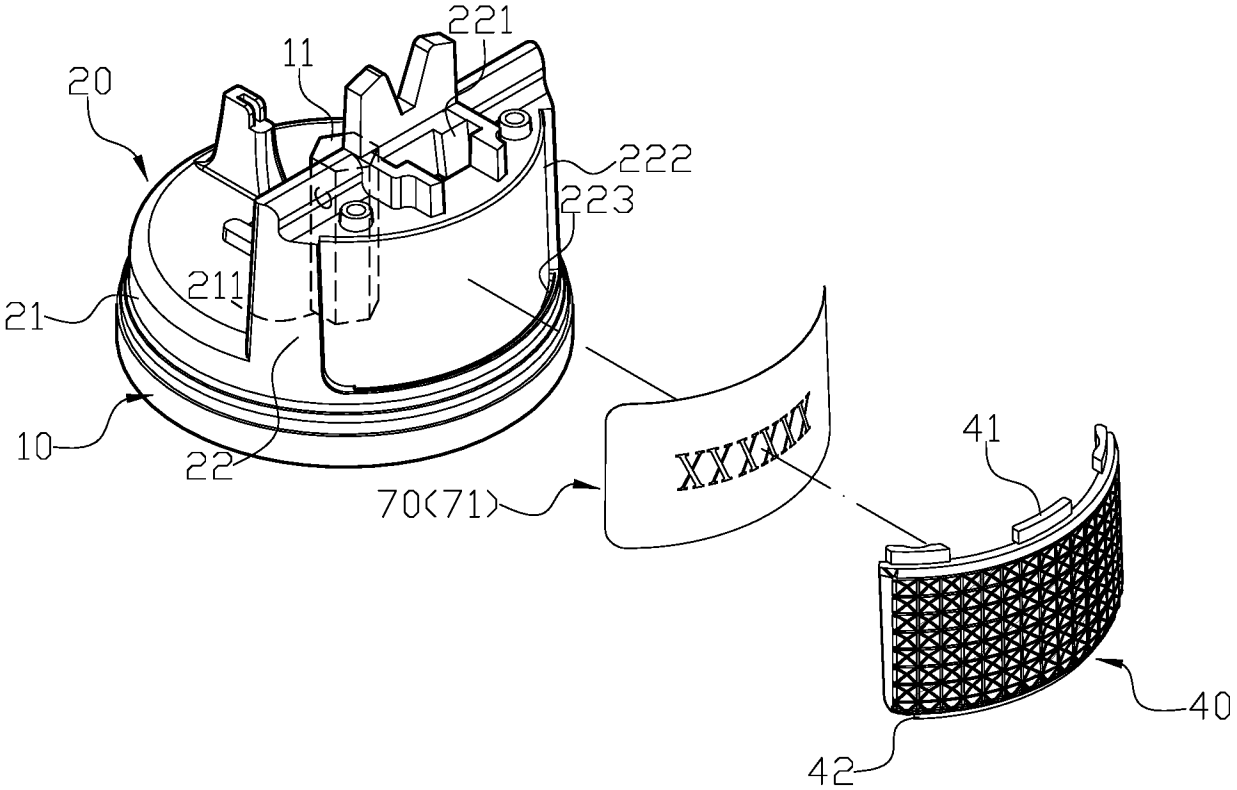
FIG. 7 is a three-dimensional exploded view of a fourth embodiment of the knife sharpener in the present invention.
Figure 8:
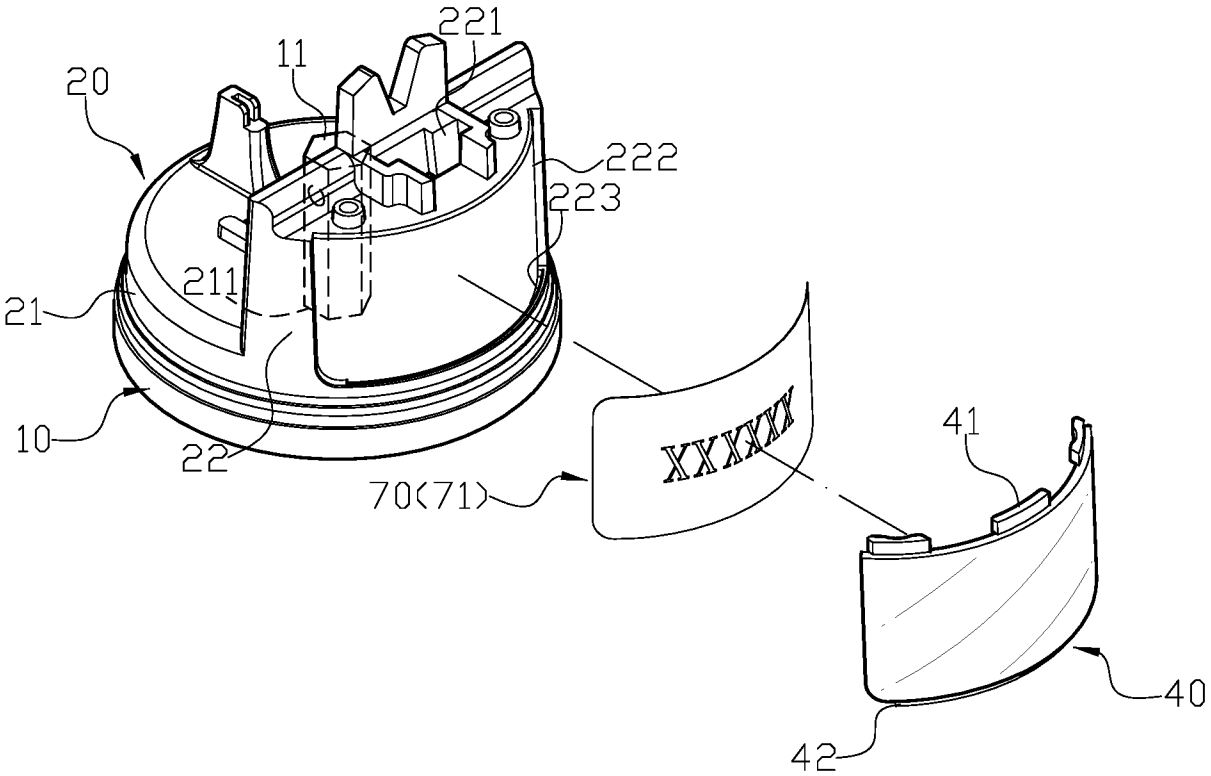
FIG. 8 is a three-dimensional exploded view of a fifth embodiment of the knife sharpener in the present invention.

In a particular embodiment, an outer surface of the first cover (40) is formed in continuous ups and downs (as shown in FIGS. 1 to 6), or in diamond-shaped pattern (as shown in FIG. 7), or in flat (as shown in FIG. 8) so as to enables the indicating member (70) to have different visual effects.

In actual application, the suction cup (10) is coupled with a plan surface, and a user can pull the control handle (50) to enable the abutting block (53) to pull the lever (11) of the suction (10). Meanwhile, a periphery of the main base (20) is adapted to press against the top surface of the suction cup (10) so as to enable the suction cup (10) to create vacuum and attach on the plan surface. Then, the user can position a knife or tool needed to be sharpened between the two sharpening stones (31) of the sharpening set (30) and start grinding.

Comparing with conventional knife sharpener, the present invention is advantageous because: (i) with the suction cup (10), the knife sharpener of the present invention can be attached on a plan surface, so that a user has no need to use one hand to hold the knife sharpener, which is more safe to use; and (ii) with the first cover (40) and the indicating member (70), the knife sharpener of the present invention can meet different customer needs including presenting business and personal appearance, and distinguishing the use for different sharpening items, thereby improving the practicality thereof.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A knife sharpener comprising a suction cup, a main base, a sharpening set, a first cover, a control handle, and an upper cover:

wherein the suction cup is adapted to create vacuum so as to enable the knife sharpener to be attached on a working surface, and a lever extends from a top surface of the suction cup;

wherein the main base has different heights of a first portion and a second portion thereon to form a stepped shape, and the height of the second portion is higher than the height of the first portion, and the first portion comprises a first through hole thereon; when an upper end of the suction cup is coupled on a lower end of the main base, the lever is adapted to penetrate through and stick out of the first through hole of the main base; a first hole is formed on a top surface of the second portion, and a curved receiving space is formed at a front end of the second portion which is located away from the first portion, and a concave surface of the curved receiving space is faced toward the first portion; a locating groove is formed below the curved receiving space, and the first cover is engaged with the locating groove when received into the curved receiving space; an indicating member is configured to be coupled between the curved receiving space and the first cover, and a position of the indicating member is secured when the upper cover is coupled with the top surface of the second portion;

wherein the sharpening set comprises two pieces of sharpening stones which are coupled together to form a sharpening space therebetween;

wherein the first cover having transparency is a board body which is shaped according to the curved receiving space, and an upper locating piece and a lower locating piece respectively and vertically protrude from an upper edge and a lower edge of the first cover; when the first cover is received in the curved receiving space, the lower locating piece is adapted to insert into the locating groove, and the upper cover is coupled with the main base; the upper cover has a blocking edge downwardly protruding front a front edge of the upper cover, and the blocking edge is adapted to block a front end of the upper locating piece when the upper cover is coupled with the main base; the upper cover is detachable so that the first cover and the indicating member are respectively replaceable;

wherein the control handle, which is a ring body, has a second through hole axially penetrating through a central portion thereof, and a connecting portion vertically protrudes from a middle portion of a lower end of the control handle, and an abutting block is horizontally extended from the connecting portion to protrude from a rear end of the control handle; through the connecting portion, the control handle is pivotally connected to the lever which upwardly protrudes out from the first through hole, and the upper cover is adapted to penetrate through the second through hole; when the control handle is pulled, the abutting block is configured to abut against the first portion of the main base so as to pull the suction cup to create vacuum; and wherein the upper cover comprises a third through hole penetrating through a top surface thereof, and a vertical supporting block having a triangular notch on top is formed on the top surface of the upper cover and located directly behind the third through hole; a front end of the supporting block is coupled with the two sharpening stones so as to form a stepped shape; the sharpening set is positioned into the first hole of the main base, and the upper cover is secured with the second portion of the main base so as to secure a position of the sharpening set on the main base; an upper portion of the sharpening set is adapted to upwardly stick out from the third through hole, and two rear portions of the two sharpening stones are adapted to be abutted against the supporting block.

2. The knife sharpener of claim 1, wherein a spring is coupled between the suction cup and the main base.

3. The knife sharpener of claim 1, wherein the first hole, the third through hole, and the supporting block are tilted to enable the sharpening set to be rearward tilted at 5-10 degree of inclination angle relative to a vertical line after installed on the main base.

4. The knife sharpener of claim 1, wherein the indicating member is a nameplate which is adapted to represent a corporation or personal image.

5. The knife sharpener of claim 1, wherein the indicating member is a paper sheet that distinguishes the use for different sharpening items.

6. The knife sharpener of claim 1, wherein the upper locating piece of the first cover comprises a plurality of pieces separated from each other.

7. The knife sharpener of claim 1, wherein an outer surface of the first cover is formed in diamond-shaped pattern.

8. The knife sharpener of claim 1, wherein an outer surface of the first cover is flat.

* * * * *